US007339447B2

(12) United States Patent
Chen et al.

(10) Patent No.: US 7,339,447 B2
(45) Date of Patent: Mar. 4, 2008

(54) HIGH-VOLTAGE TRANSFORMER COIL WITH ACOUSTIC WAVE GUIDING FUNCTION

(75) Inventors: Jiann-Fuh Chen, No. 1, Tahsueh Rd., Tainan City (TW); Cheng-Chi Tai, No. 1, Tahsueh Rd., Tainan City (TW); Tsorng-Juu Liang, Tainan (TW); Ching-Chau Su, Tainan (TW); Ching-Shun Yi, Tainan (TW); Chien-Yi Chen, Tainan (TW)

(73) Assignees: Unelectra International Corp., Taipei (TW); Precision International Corp., Taipei (TW); Jiann-Fuh Chen, Tainan (TW); Cheng-Chi Tai, Tainan (TW)

( * ) Notice: Subject to any disclaimer, the term of this patent is extended or adjusted under 35 U.S.C. 154(b) by 0 days.

(21) Appl. No.: 11/290,583

(22) Filed: Dec. 1, 2005

(65) Prior Publication Data

US 2007/0126530 A1 Jun. 7, 2007

(51) Int. Cl.
*H01P 3/00* (2006.01)

(52) U.S. Cl. ..... 333/242; 336/195

(58) Field of Classification Search ..... 315/39; 333/193, 239, 242; 324/536; 336/137, 195, 336/199; 310/334
See application file for complete search history.

(56) References Cited

U.S. PATENT DOCUMENTS

| | | | | |
|---|---|---|---|---|
| 4,510,812 | A * | 4/1985 | Feng | 73/644 |
| 5,197,279 | A * | 3/1993 | Taylor | 60/203.1 |
| 6,157,282 | A * | 12/2000 | Hopkinson | 336/57 |
| 6,494,617 | B1 * | 12/2002 | Stokes et al. | 374/152 |
| 7,180,303 | B1 * | 2/2007 | Chen et al. | 324/536 |

* cited by examiner

*Primary Examiner*—Douglas W. Owens
*Assistant Examiner*—Jimmy Vu
(74) *Attorney, Agent, or Firm*—Rosenberg, Klein & Lee

(57) ABSTRACT

The present invention relates to a high-voltage transformer coil with acoustic wave guiding function, which comprises a plurality of wound wires, an insulated material for packaging said wound wires to form a coil, a high-voltage connector formed on a side of said coil, and at least one wave guide formed on the other side of said coil to transmit acoustic waves generated due to discharge. The high-voltage coil for transmitting acoustic wave of the present invention is particularly suitable for cast resin transformers.

7 Claims, 5 Drawing Sheets

HIGH-VOLTAGE TRANSFORMER COIL WITH ACOUSTIC WAVE GUIDING FUNCTION

BACKGROUND OF THE INVENTION

1. Field of the Invention

The present invention relates to a high-voltage transformer coil with acoustic wave guiding function, and more particularly to a high-voltage coil with a wave guide which comprises protrusions and inner caves arranged alternately, so that the acoustic waves generated due to discharge can be well transmitted to a measuring device without damage thereto; and the present invention is preferably suitable for a cast resin transformer.

2. Related Prior Arts

For manufacturers, properties of electrical power, such as stability, are important to prolong life of equipment and maintain quality of products. Unstable power or unpredictable shutting off do not facilitate yield and even result in lots of waste product. In high-technological processes, it's much desired for good and stable power supplying due to high-priced product and high cost thereof.

Currently, electrical power generated in the power plant is first transmitted to substations via high-voltage power cables, and then delivered to different areas via distributors, and finally to respective users after using transformer to decrease voltage.

The traditional oil-immersed transformer is primarily assembled by an iron core and a coil which contains insulated oil therein to increase insulation and heat-dissipation of the transformer. To prolong life of the transformer, the insulated oil should be changed after using for a certain period, and thus cost for maintenance is increased. Once the transformer is too hot and sparks at a temperature over the flame point of the insulated oil, the insulated oil will burns and the transformer could explode. Such phenomenon is dangerous and results in disrupture of the plants. Therefore, the oil-immersed transformer is gradually replaced with the cast resin transformer for safety.

As shown in FIGS. 3 and 4, a high-voltage-coil set (9) of the cast resin transformer comprises a iron core (91) formed by a plurality of stacked silicon steel sheets and wound with wires to form three high-voltage coils (92). The three high-voltage coils (92) are embedded with insulated resin (not shown in figures) to form the high-voltage-coil set (9) of the cast resin transformer. Each of the high-voltage coils (92) is primarily constructed by wound wires (921) which are embedded with insulated material (922) to form an annular coil. The high-voltage coil (92) further comprises a high-voltage connector (923) which is composed of terminals (924) and high-voltage contacts (925). Heat-dissipation is achieved by air convection in the high-voltage coil (92). Compared with the traditional oil-immersed transformer, the cast resin transformer needs no oil and is safer without flaming. In addition, the cast resin transformer exhibits merits of moisture-proof, less noise and flame-retardant, and thus is suitable for application in hospitals, high-technological plants, express and air service.

Maintenance and fault-detection for power equipment are also very important. For the cast resin transformer, malfunctions generally caused by poor insulation of the high-voltage coil and thus partial discharge occurs. If no detection is provided in time, resin of the high-voltage coil in the cast resin transformer will be rifted and operations of the plant could be disrupted.

FIG. 5 shows the partial discharge similar to pulses which generate mechanical pressure waves as acoustic emission. Such phenomenon could be caused by collision between molecules of material and adjacent structures, and form a sound source (93) to emit acoustic waves. These acoustic waves will emit inside the equipment and thus can be detected with an acoustic emission (AE) method. By attaching an AE sensor (94) to the surface of the transformer, the piezoelectric material inside the AE sensor (94) will transform the AE signals of mechanical pressure waves into electrical signals which are then amplified with a preamplifier (96). A digital oscilloscope (97) is provided to analyze the acoustic emission signals and therefore statuses of the equipment can be predicted.

For the AE method applied to the high-voltage coil, some issues should be noticed as follows:

1. Decaying of the Acoustic Waves

During producing the high-voltage coil, interspace of the molds is filled with glass fiber for associating with resin to increase mechanical strength thereof. However, glass fiber can absorb the acoustic waves, which will results in decaying of the acoustic waves during transmitting in the high-voltage coil. Therefore, it's important to solve the above problem when utilizing the AE method to detect partial discharge.

2. Damage to the Measuring Device or the Transformer

When attaching the probe of the measuring device to surfaces of the high-voltage coils, the distance between the coil and the probe is about only 3mm. Therefore, high potential is formed between them for high-voltage input, which may cause the coil to generate corona discharge to the probe and misguide the detection; and even more seriously cause damage of the transformer and measuring device.

The present invention therefore develops a high-voltage coil for transmitting acoustic waves to a measuring device so as to improve demerits aforementioned.

SUMMARY OF THE INVENTION

The major object of the present invention is to provide a high-voltage coil with wave guiding function for transmitting acoustic waves to a measuring device, whereby detection of the acoustic waves can be conveniently carried out with accuracy.

Another object of the present invention is to provide a cast resin transformer, so that the probe of the measuring device does not necessarily contact to the surface of the high-voltage coil, and thus the measuring device is secured.

To achieve the above objects, the high-voltage coil of the present invention comprises a plurality of wound wires, an insulated material for packaging the wound wires to form a coil, a high-voltage connector formed on a side of the coil, and at least one wave guide formed on the other side of the coil to transmit acoustic waves generated due to discharge. The wave guide comprises a plurality of protrusions and a plurality of inner caves arranged alternately. The wave guide is appropriately formed on a side of the coil, wherein the protrusions contact with a surface of the coil outside the wound wires. Accordingly, the high-voltage coil can be applied to transmitting acoustic waves from discharge and suitable for the cast resin transformer.

DETAILED DESCRIPTION OF THE PREFERRED EMBODIMENTS

Features and merits of the present invention can be further illustrated with the preferred embodiment and drawings.

Figure 1:
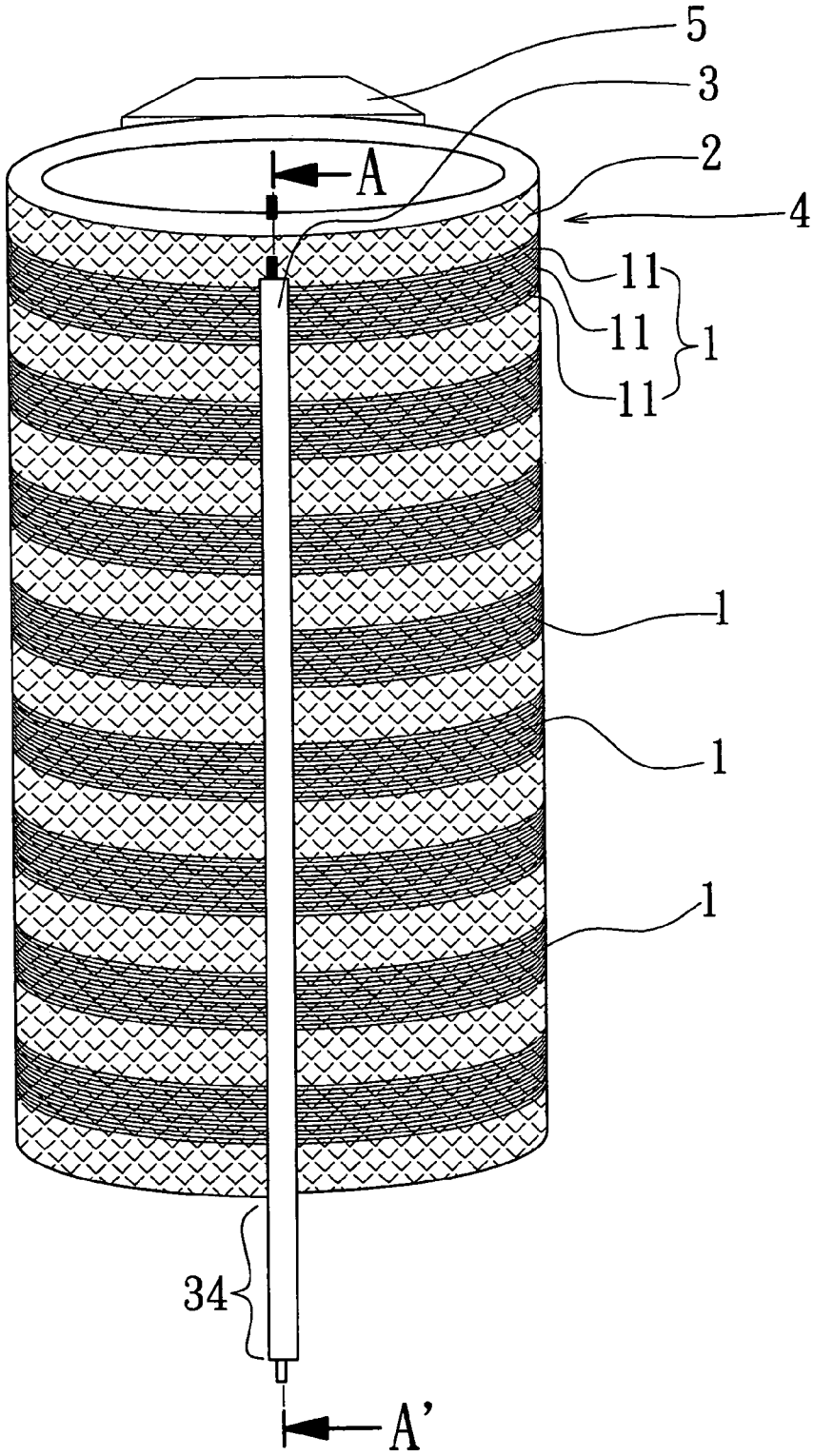
FIG. 1 is a perspective view of an embodiment in accordance with the present invention.
Figure 2:
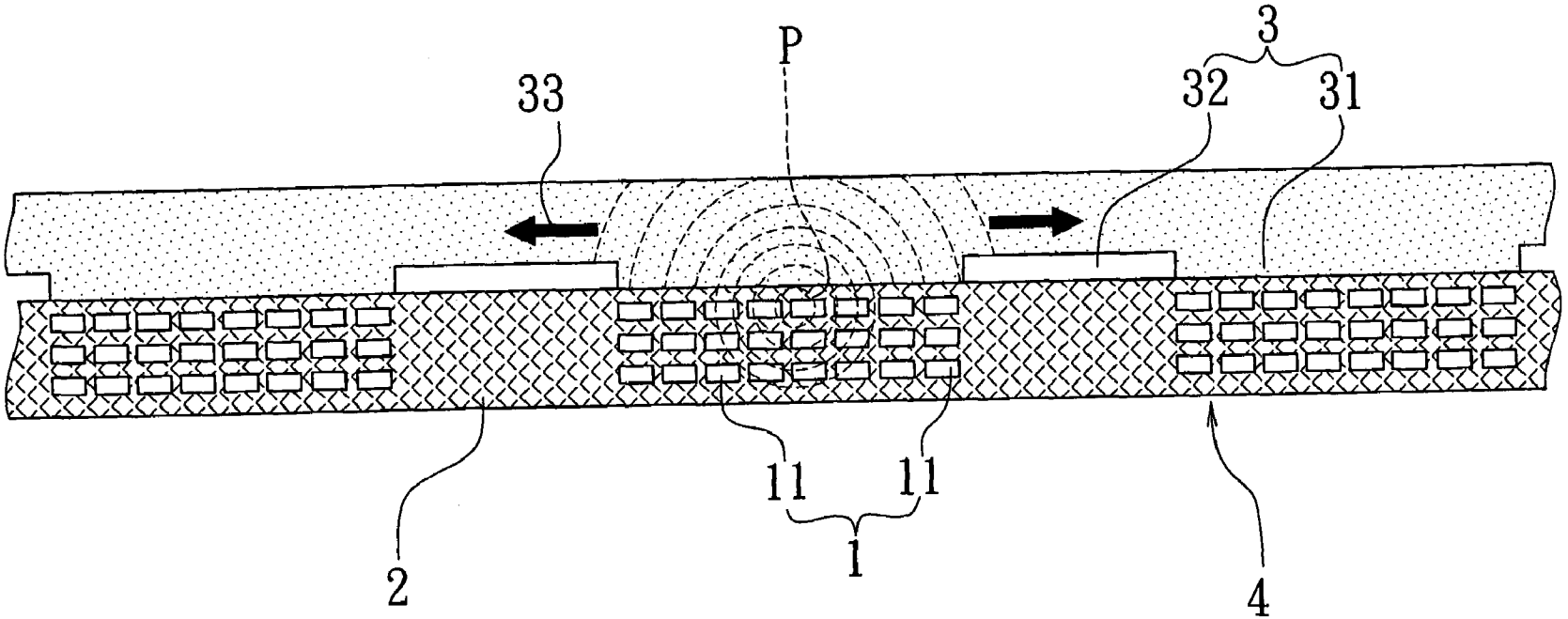
FIG. 2 is a cross section view along A-A' of FIG. 1.
Figure 3:
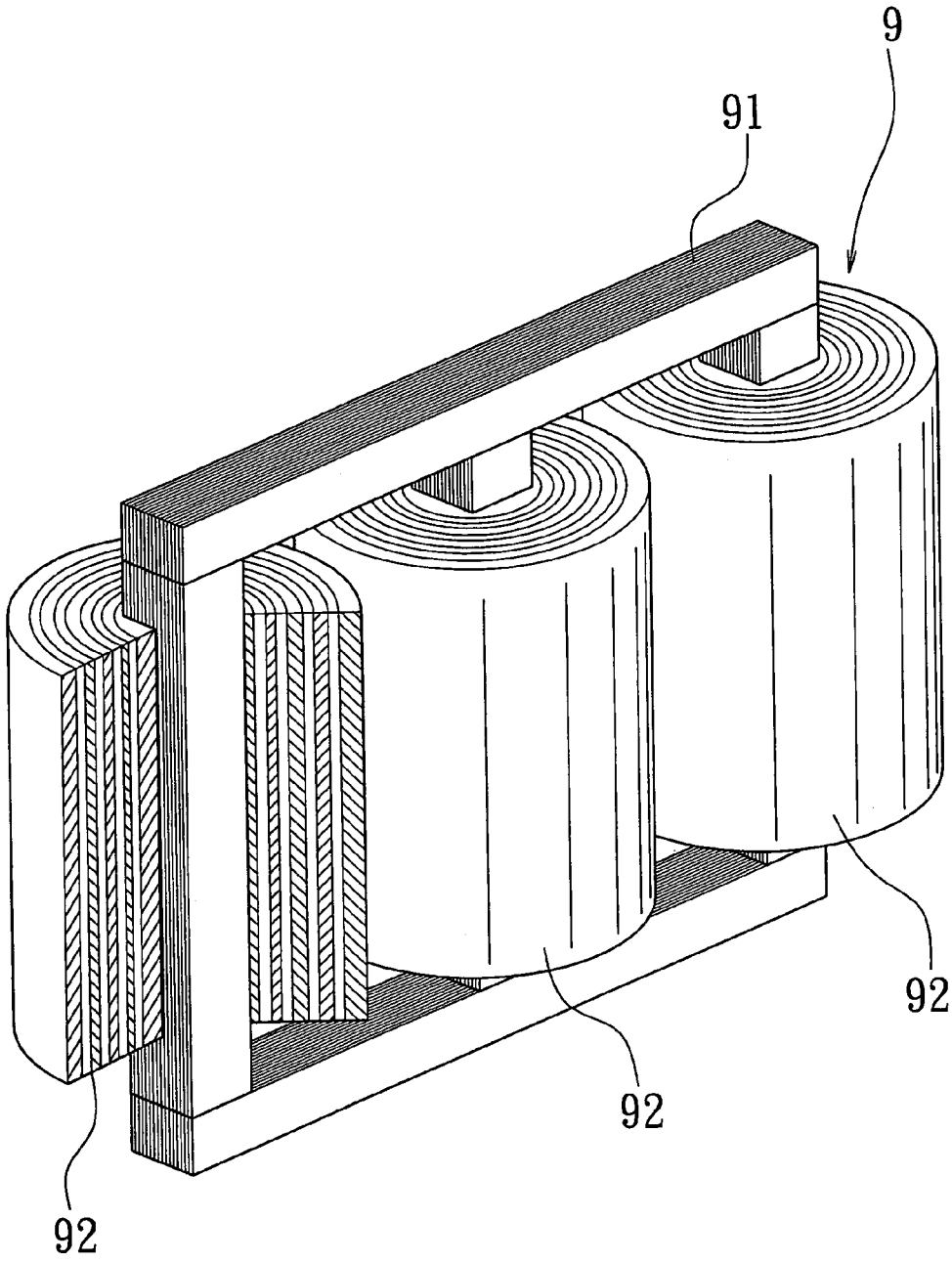
FIG. 3 (PRIOR ART)
FIG. 3 is a perspective view of three conventional high-voltage coils for the cast resin transformer.
Figure 4:
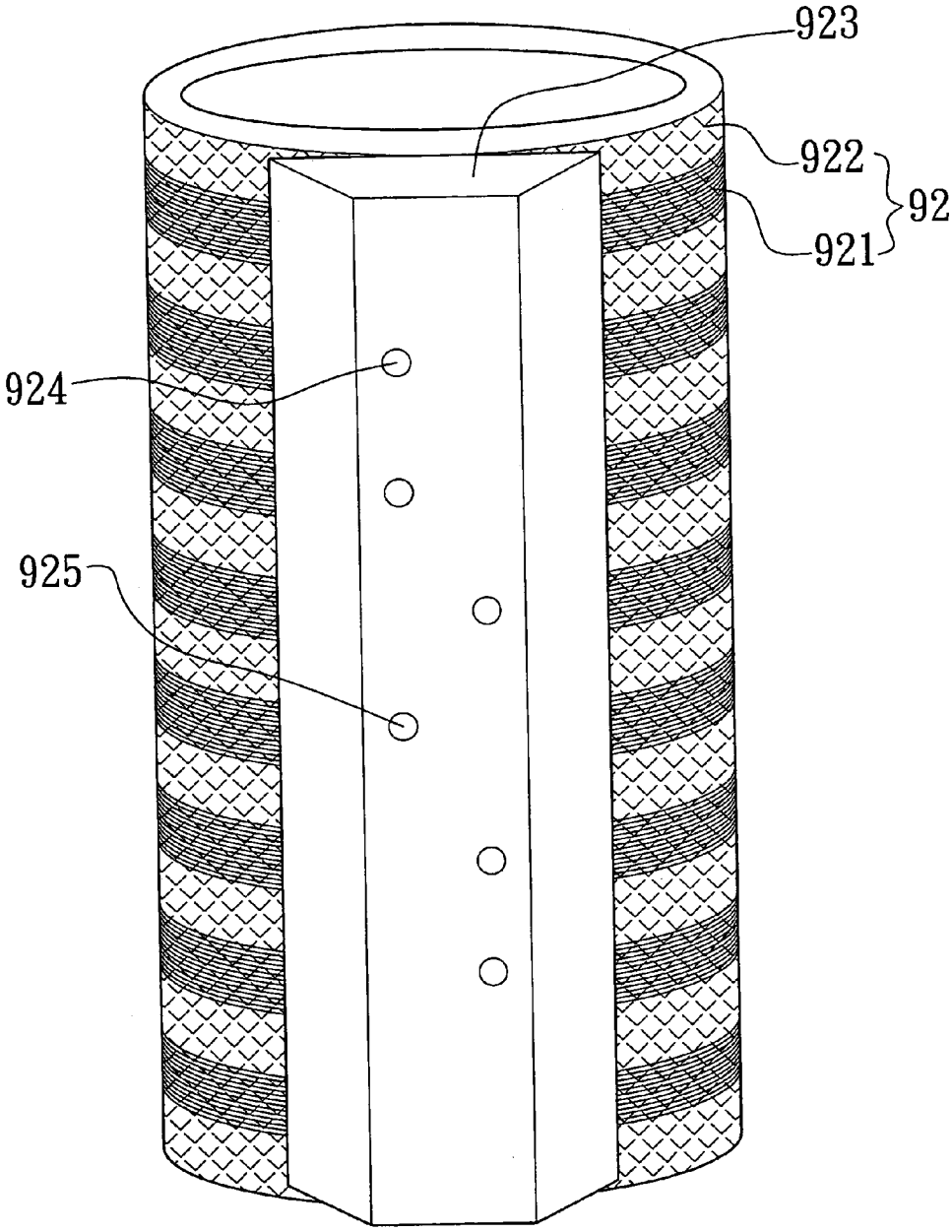
FIG. 4 (PRIOR ART)
FIG. 4 is a perspective view of the conventional high-voltage coil.

Please refer to FIGS. 1 and 2, in which a high-voltage coil for transmitting acoustic wave comprises a plurality of wound wires (1), an insulated material (2) and a wave guide (3). The wound wires (1) are substantially composed of a plurality of wires (11), and preferably the copper wire with good conductivity. The wound wires (1) are packaged with the insulated material (2) to form an annular coil (4). The insulated material (2) is preferably made from glass fibers and resin due to their good properties of insulation, rigidity and anti-deformity. A high-voltage connector (5) is further formed on a side of the coil (4).

The wave guide (3) for transmitting acoustic waves generated from discharge is appropriately arranged on one side of the coil (4), and preferably opposite to the high-voltage connector (5) relative to the coil (4). The wave guide (3) is also preferably in a normal direction to the wound wires (1), i.e., parallel to an axial of the coil (4) when considering safety, as the resin here is as thin as only about 3 mm and a distance from the high-voltage side is the largest. The wave guide (3) can be made from any proper materials. According to test results, tempered/reinforced glass exhibits the best properties about acoustic wave transmission, insulation, thermal-sustainment, mechanical strength after reinforcing, and rigidity unaffected with impact and temperature.

The wave guide (3) comprises a plurality of protrusions (31) and a plurality of inner caves (32) arranged alternately. The protrusions are particularly in the shape of zigzag and contact with a surface of the coil (4) outside the wound wires (1). Between two adjacent wires, the inner cave (32) of the wave guide (3) doesn't contact with the coil (4). When partial discharge generated at a poor-insulation position (P) in the coil (4) as an acoustic emission source, acoustic wave signals will be transmitted to the wave guide (3) via the protrusions (31). Arrows (33) indicate the directions of the acoustic wave transmitting toward ends of the wave guide (3), other than where between the wires which will result in losses of acoustic energy.

To prevent the measuring device from interference or damage due to high-voltage discharge of the high-voltage coil, one end of the wave guide (3) of the present invention extends from the coil (4) to form an extension (34). The extension (34) provides a safe distance for the measuring device, so that the acoustic emission sensor (94) thereof is not affected by high-voltage discharge. The extension can be as long as 15 cm or other proper lengths. In addition to only one wave guide illustrated in this embodiment, more wave guides can be arranged according to desire or measuring values.

Figure 5:
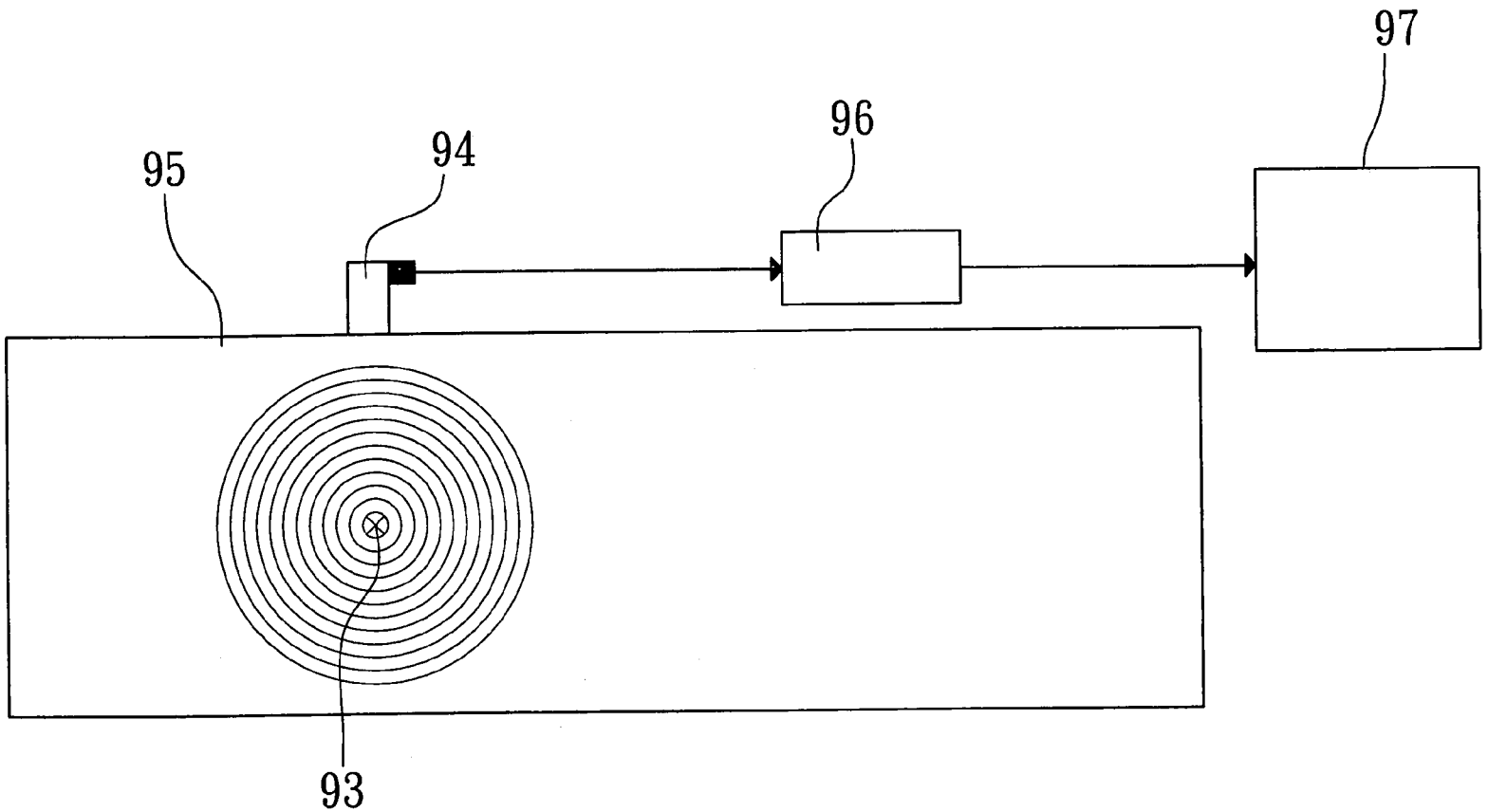
FIG. 5 shows the detection mechanism for discharge with the measuring device.

Application of the high-voltage coil for transmitting acoustic waves according to the present invention is shown in FIG. 5, in which an acoustic emission sensor (94) of the measuring device is attached on the extension (34) of the wave guide (3). Accordingly, no matter which one of the wound wires (1) happen to partial discharge, acoustic wave signals thereof can be detected through the wave guide (3). In accordance with the measuring device, detection can be achieved without damaging the measuring device and hurting the operator. The present invention is particularly suitable for cast resin transformer.

In summary, merits of the present invention are as follows:

(1) An appropriate path for transmitting acoustic waves can be provided by arranging the wave guide on one side of the high-voltage coil so as not to affect the high-voltage coil; in order to promote transmission of the acoustic wave, decreasing thickness of the insulated material for packaging the wound wires will weaken mechanical strength of the high-voltage coil and leakage of the resin due to the high-voltage coil expanding at high temperature and shrinking at low temperature.

(2) Insulation is maintained by applying tempered/reinforced glass to the wave guide due to its good properties about acoustic wave transmission, insulation, thermal-sustainment, mechanical strength after reinforcing, and rigidity unaffected with impact and temperature.

(3) Discharge of the high-voltage coil to the probe of the measuring device is avoided as the wave guide is extended downward for a safe distance so as to secure the measuring device and the operator.

It should be noticed that slight modifications in the location, structure and shape of the wave guide made by one skilled in this art can not be departed from the scope and spirit of the present invention.

What is claimed is:

1. A high-voltage transformer coil with acoustic wave guiding function, comprising:

a plurality of wound wire portions spaced one from the other by an insulated material for packaging said wound wire portions to form a coil;

a high-voltage connector formed on a side of said coil; and at least one acoustic wave guide formed on the other side of said coil, said acoustic wave guide extending transversely over each of said wound wire portions to transmit acoustic waves generated thereby due to discharge to an acoustic emission sensor;

wherein said wave guide comprises a plurality of protrusions and a plurality of inner caves arranged alternately, and said protrusions and inner caves aligning respectively with said wound wire portions and said insulated material disposed therebetween.

2. The high-voltage transformer coil as claimed in claim 1, wherein said high-voltage coil is arranged in a cast resin transformer.

3. The high-voltage transformer coil as claimed in claim 1, wherein said wave guide and said high-voltage connector are respectively located on opposite sides of said coil.

4. The high-voltage transformer coil as claimed in claim 1, wherein said wave guide is made from tempered/reinforced glass.

5. The high-voltage transformer coil as claimed in claim 1, wherein said wound wire portions are coaxially disposed, said acoustic waveguide extending in an axial direction to a terminal end projecting beyond said coil, said acoustic emission sensor being coupled to said terminal end.

6. A high-voltage transformer coil with acoustic wave guiding function, comprising:

a plurality of wound wire portions spaced one from the other by an insulated material for packaging said wound wire portions to form a coil;

a high-voltage connector formed on a side of said coil; and at least one acoustic wave guide formed on the other side of said coil, said acoustic wave guide extending transversely over each of said wound wire portions to transmit acoustic waves generated thereby due to discharge to an acoustic emission sensor;

wherein said wave guide has a zigzag surface contacting with said high-voltage coil.

7. A high-voltage transformer coil with acoustic wave guiding function, comprising:

a plurality of wound wire portions spaced one from the other by an insulated material for packaging said wound wire portions to form a coil;

a high-voltage connector formed on a side of said coil; and at least one acoustic wave guide formed on the other side of said coil, said acoustic wave guide extending transversely over each of said wound wire portions to transmit acoustic waves generated thereby due to discharge to an acoustic emission sensor;

wherein said wave guide is extended from one end of said coil to form an extension, so that detecting for partial discharge would not be affected by high-voltage discharge.

* * * * *